US005645121A

United States Patent [19]

Barnes

[11] Patent Number: 5,645,121

[45] Date of Patent: Jul. 8, 1997

[54] METHOD OF CONTINUOUS CASTING USING SEALED TUNDISH AND IMPROVED TUNDISH SEAL

[75] Inventor: Thomas Barnes, Ecorse, Mich.

[73] Assignee: National Steel Corporation, Mishawaka, Ind.

[21] Appl. No.: 583,720

[22] Filed: Jan. 5, 1996

[51] Int. Cl.[6] ..... B22D 11/10

[52] U.S. Cl. ..... 164/475; 164/415; 164/488; 164/437

[58] Field of Search ..... 164/335, 437, 164/475, 415, 488; 222/591, 594

[56] References Cited

U.S. PATENT DOCUMENTS

| | | | |
|---|---|---|---|
| 2,784,961 | 3/1957 | Coupette et al. | 164/335 |
| 3,125,440 | 3/1964 | Hornal et al. | 75/49 |
| 3,352,351 | 11/1967 | Sickbert | 164/335 |
| 3,439,735 | 4/1969 | Holmes | 164/437 |
| 3,457,985 | 7/1969 | Wilson | 164/437 |
| 3,459,346 | 8/1969 | Tinnes | 222/566 |
| 3,460,725 | 8/1969 | Golde et al. | 164/335 |
| 3,465,811 | 9/1969 | Castelet et al. | 164/437 |
| 3,558,256 | 1/1971 | Bick et al. | 164/281 |
| 3,888,294 | 6/1975 | Fastner et al. | 164/415 |
| 4,090,552 | 5/1978 | Laird et al. | 164/438 |
| 4,538,670 | 9/1985 | LaBate | 164/475 |
| 4,577,839 | 3/1986 | Carlson et al. | 266/272 |
| 4,624,292 | 11/1986 | Labate | 164/475 |
| 4,671,499 | 6/1987 | Ishiyama et al. | 266/275 |
| 5,361,825 | 11/1994 | Lax et al. | 164/437 |
| 5,368,208 | 11/1994 | Nishimura et al. | 222/603 |

FOREIGN PATENT DOCUMENTS

| | | | |
|---|---|---|---|
| 55-10312 | 1/1980 | Japan | 164/437 |

*Primary Examiner*—Kurt Rowan
*Assistant Examiner*—Randolph S. Herrick
*Attorney, Agent, or Firm*—James L. Bean; Kerham, Stowell, Kondracki & Clarke

[57] ABSTRACT

A tundish used in a continuous steel casting operation is sealed to permit effective purging of the tundish to eliminate free oxygen and nitrogen by providing a plurality of generally rectangular planar sealing boards of refractory fiber material having sufficient density to be self-supporting and placing the boards in side-by-side relation on the open top of the tundish prior to installation of the refractory cover whereby the sealing boards form a gasket between the cover and tundish top wall, and form a continuous panel underlying the cover. The refractory fiber material may be penetrated by the ladle shroud tube and/or the tundish stopper rod(s).

9 Claims, 3 Drawing Sheets

METHOD OF CONTINUOUS CASTING USING SEALED TUNDISH AND IMPROVED TUNDISH SEAL

BACKGROUND OF THE INVENTION

1. Field of the Invention

This invention relates to the continuous casting of steel and more particularly to the use of a sealed tundish in the continuous casting of steel, and to an improved tundish seal for such use.

2. Description of the Prior Art

The adverse effects of atmospheric oxygen and nitrogen contacting molten steel in a pouring or casting operation are well known, and numerous patents have issued on apparatus and devices for shielding the molten metal from the atmosphere to prevent oxidation and nitrogen pickup during such operations. In a continuous casting operation, it is conventional for the molten steel to be transported from the convertor to the caster in a ladle where it is supported on a turret for movement into position above a tundish having its pouring outlet, or outlets, directly above the open top of the caster mold, or molds.

Molten steel in the ladle is covered with a layer of slag, and is dispensed through an outlet in the ladle bottom under control of a slide valve. A refractory shroud tube attached to the slide valve extends through an opening in the tundish cover to a point beneath the surface of the pool of metal in the tundish during casting. From the tundish, the metal flows through one or more bottom outlets under control of stopper valves, again through a refractory tube or tubes extending below the level of the molten metal in the caster mold. Thus, the molten steel is shielded from the atmosphere in its flow path from the ladle into the tundish, and from the tundish into the mold. In the tundish, however, and particularly during the initial filling of a newly lined tundish, contact with the atmosphere can result in substantial nitrogen pickup and oxidation of the molten steel. Indeed, in casting of high purity prime priced steels suitable for forming exposed automobile body components or for tinplate, it has in the past been generally necessary to downgrade or even scrap up to 5 or 6 slabs, each weighing up to 30,000 pounds or more, cut from the leading end of a continuous strand cast using a newly lined tundish.

Attempts have been made to purge atmosphere containing free oxygen and nitrogen from the interior of a tundish by injecting an inert gas into the tundish, one such continuous casting system being illustrated in U.S. Pat. No. 3,558,256; however, because of the size of the tundish used in modern casters, and the number and size of openings required in the conventional tundish cover, such attempts to purge the tundish generally have required an excessive amount of inert gas and have not been entirely successful. Further, in many tundishes in use today, particularly for multi-strand casters, the cover itself is formed in a number of sections having openings therethrough as for the pouring of steel from the ladle or to accommodate the insertion and manipulation of the stopper rods employed to control the flow rate from the tundish.

Dimensional tolerances in commercial continuous casting machines are such that openings in the tundish cover are necessarily substantially larger than the shroud tube or stopper rod to be inserted therethrough. Unavoidable spacing or cracks between adjacent tundish cover sections and between the cover sections and the top of the tundish, and the opening in the sidewall for a dumping spout provide additional openings to the interior of the tundish. Attempts to purge such prior art covered tundishes have therefore been only marginally effective.

U.S. Pat. No. 5,368,208 discloses a further attempt to shield air from molten metal in a continuous casting facility and illustrates, in the drawings, a large opening into the tundish in the form of a pouring or dumping spout. No attempt is made to seal the top of the tundish beneath the cover.

U.S. Pat. No. 3,459,346 discloses a molten metal pouring spout employed between a ladle and a tundish and illustrates the pouring spout projecting downwardly through the cover on the tundish. FIG. 1 illustrates the spout extending through the opening in the tundish cover with substantial clearance as is considered necessary in such operations.

It is, accordingly, a primary object of the present invention is to provide an improved seal between the open top of the tundish and the rigid tundish cover to substantially eliminate the ingress of atmospheric air into the tundish by maintaining a positive purging gas pressure in the tundish during the casting operation.

Another object is to provide such a tundish seal which enables efficient and economical purging and pressurizing of the tundish space with an inert gas to effectively eliminate free oxygen and nitrogen from the tundish prior to and during the casting operation.

Another object is to provide a lightweight, economical and efficient, disposable seal which may be quickly and easily positioned over the open top of the tundish before placing the cover thereon, with the seal material extending over the openings provided in the tundish cover and being penetrable in the areas of such openings by the ladle shroud tube and tundish flow control stopper rods.

SUMMARY OF THE INVENTION

The foregoing and other objects and advantages are achieved in accordance with the present invention by providing a temperature resistant tundish seal in the form of a plurality of generally rectangular, dimensionally stable and self-supporting sealing boards formed from a refractory ceramic fiber. The boards are placed in side-by-side overlapping configuration to completely cover the open top of a newly lined tundish to be used in a continuous casting operation. The conventional tundish cover consisting of a plurality of cast refractory slabs is then placed onto the tundish on top of the sealing boards. The boards are rabbeted along their opposed side edges to provide a shiplap joint between adjacent boards to thereby form an effective seal beneath the tundish cover. The cover slabs compress the refractory fiber boards between their bottom surface and the upwardly directed peripheral edge of the refractory sidewalls of the tundish to provide a gasket-type seal.

The sealing boards not only provide an effective seal for the top of the tundish but also serve as an effective thermal insulation limiting the transfer of heat from the interior of the tundish to the cover both during preheating of a newly lined tundish and during casting. Prior to or after installation of the tundish cover, the sealing boards may be scored in the area of the shroud tube opening and the stopper rod opening (s) to enable these elements to readily penetrate the boards without producing an excessive opening at the beginning of the casting operation.

A newly lined, sealed tundish is preheated in the conventional manner. During preheating, the sealing boards act as a thermal blanket reducing the heat absorption by the tundish cover and thereby accelerating the heating of the body of the tundish. By substantially reducing the effective opening area of the closed tundish, the inflow of diluting cooling air is reduced and preheating efficiency is correspondingly increased.

Prior to commencing casting, and during preheating of the tundish tubes from the floor, an inert gas, preferably argon, is discharged into the tundish to purge the interior of free oxygen and nitrogen containing air. Oxygen levels, typically around 15% during this operation, is reduced to approximately 1% by use of the improved tundish seal. During purging, the inert gas forms a positive pressure which prevents ambient air from being drawn through unsealed openings such as the dumping spout. Upon commencing the pouring of molten steel into the tundish at the start of a casting run, visible emissions (smoke) escaping through any unsealed openings provides a positive indication of the tundish pressurization.

DESCRIPTION OF THE DRAWINGS

The foregoing and other features and advantages of the invention will be apparent from the detailed description contained hereinbelow, taken in conjunction with the drawings, in which:

FIG. 4 is an isometric view schematically illustrating a sealing board being scored to facilitate penetration thereof by a ladle shroud tube or the like.

DESCRIPTION OF THE PREFERRED EMBODIMENTS

Figure 1:
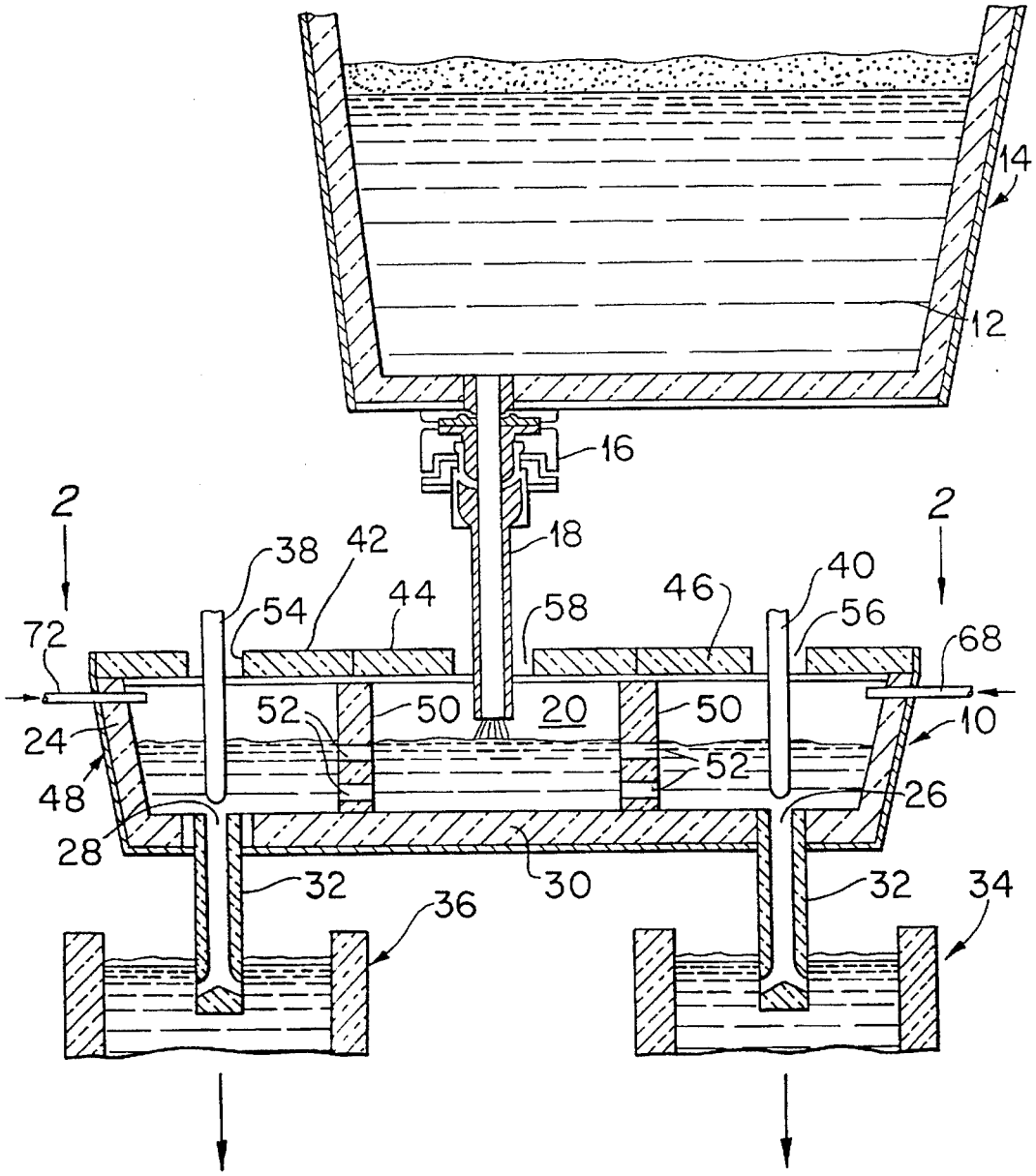
FIG. 1 is a schematic view, in section, of a continuous caster employing an improved seal tundish in accordance with the present invention.

Referring now to the drawings in detail, a tundish 10 sealed in accordance with the present invention, is illustrated schematically as being used in a continuous steel casting operation with molten steel 12 being supplied from a ladle 14 through a conventional slide valve 16 and shroud tube 18 into the sealed inner chamber 20 of the tundish. It is understood that the ladle 14 is supported on the conventional carrousel, not shown, for movement into position above the tundish 10 and then lowered to project the shroud tube 18 into the tundish interior prior to opening of valve 16.

The tundish 10 is of conventional construction, consisting of a rigid outer metal vessel 22 having a poured or cast refractory lining 24. The tundish shown is intended for use in a dual strand caster capable of simultaneously casting two strands of steel. Thus, the tundish 10 has a pair of outlets 26, 28 in its bottom wall 30, with the outlets being located near the opposed end walls of the tundish. A pair of pouring tubes 32 supported in the end walls 30 and projecting downwardly therefrom provides a sealed flow passage for molten steel from the interior of the tundish from outlets 26, 28 into caster molds 34, 36, respectively. Flow through the outlets 26, 28 into the pouring tubes 32 may be controlled by suitable means such as stopper rods 38, 40 manipulated by conventional means, not shown, from outside the tundish.

The tundish 10 includes a removable top wall, or cover, in the form of a plurality of generally rectangular cast refractory plates or slabs 42, 44, 46 supported on the upwardly directed top edge 47 of the refractory lining 24 of sidewalls 48. In addition, a pair of interior skimmer, or splash walls 50, are provided within the tundish, with a plurality of openings or orifices 52 provided in the walls 50 to permit molten steel flowing from the shroud tube 18 into the central portion of the tundish 20 to flow laterally to the end portions for discharge through the outlets 26, 28.

Cover plates 42 and 46 are provided with central openings 54, 56, to permit the insertion of slag removal rods or gas lances, for receiving the stopper rods 38, 40, respectively, and cover plate 44 has a central opening 58 for receiving the shroud tube 18. As seen in FIG. 1, the openings 54, 56 and 58 are substantially larger than the diameter of the elements projecting therethrough during the casting operation to avoid interference with the insertion and/or manipulation of the respective elements as required during casting.

It is pointed out that, while the tundish 10 is shown with two outlets, a single strand caster will only have a single pouring outlet. Also, while a cover in the form of three slabs is illustrated, any number of slab elements may be utilized as is conventional in the continuous casting art.

Figure 2:
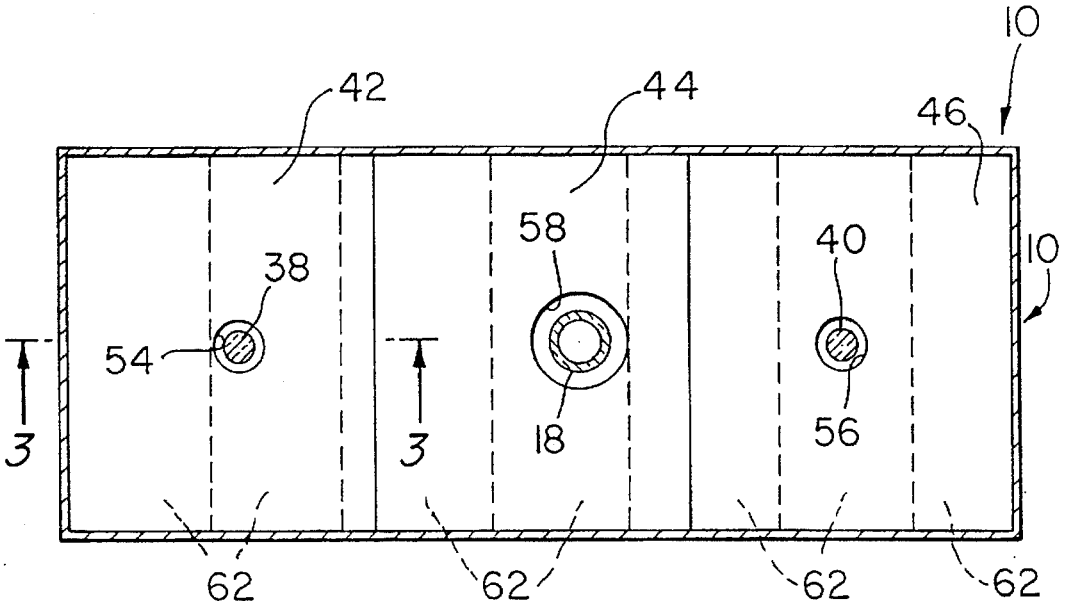
FIG. 2 is a top plan view of the tundish, taken along 2—2 of FIG. 1.
Figure 3:
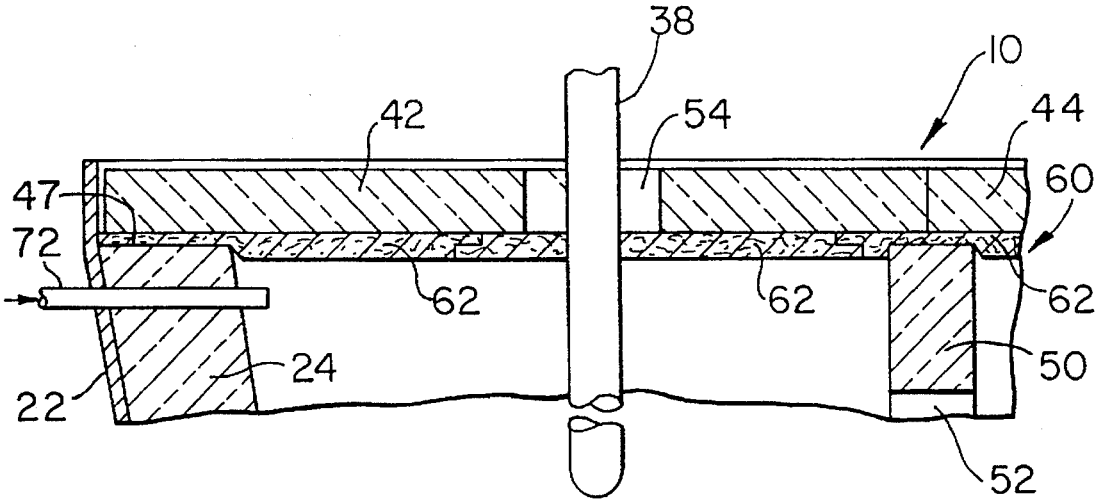
FIG. 3 is an enlarged, fragmentary sectional view taken along line 3—3 of FIG. 2.

Referring now to FIGS. 2 and 3, in accordance with the present invention, a newly relined tundish is prepared for use in the continuous casting operation by initialling providing a seal indicated generally at 60 in FIG. 3 for the open top of the tundish. The seal is in the form of a plurality of generally rectangular, dimensionally stable and self-supporting flat refractory ceramic fiber boards 62 placed in side-by-side, overlapping configuration on the upwardly directed top edge surface 47 of the tundish sidewall 48. Also as seen in FIG. 3, the tundish comprises a rigid metal outer shell 22 which projects upwardly above the top edge surface 47 and cooperates therewith to provide a recessed ledge positioning and retaining the ceramic boards 62 and the cast refractory top panels 42, 44 and 46 in position on the open top of the tundish.

Figure 4:
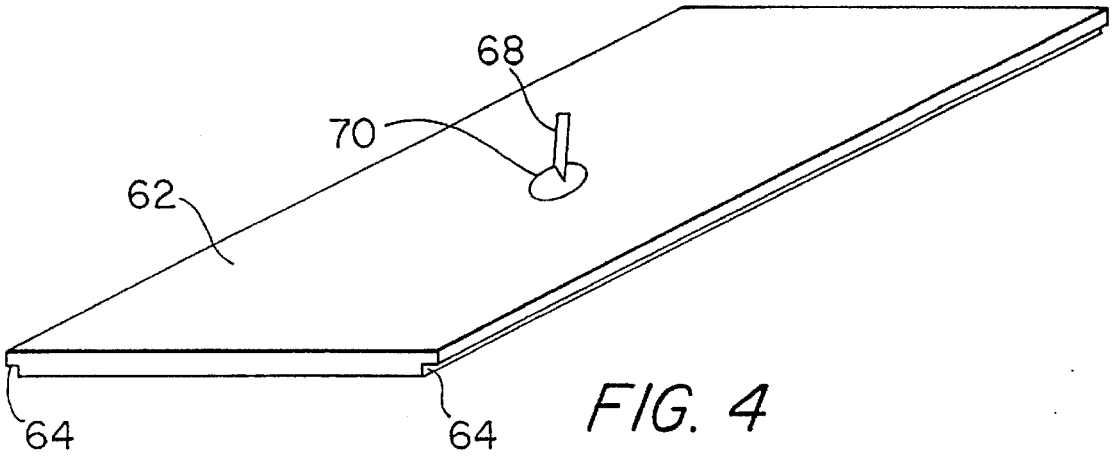

As best seen in FIGS. 3 and 4, the refractory ceramic fiber sealing boards 62 are provided with a rabbet 64 along their longitudinal side edges to provide an overlap, or shiplap-type joint between adjacent boards to form a more effective seal between adjacent boards. The boards 62 preferably are formed from a vitreous alumina silicate fiber consisting of 43% to 95% alumina fiber and about 5% to about 56% silica, with about 5% binder. The boards preferably have a density of about 0.18 to about 0.20 grams per cubic centimeter. Boards formed of this material having a thickness within the range of about 13 to about 38 millimeters have been found to be satisfactory.

Once the sealing boards are in place on top of the tundish, the heavy refractory cover panels 42, 44, 46 are placed on the tundish and compress the overlapping portion of the respective boards onto the upwardly directed surface 47 to firmly clamp and retain the sealing boards against movement. As seen in FIG. 3, the sealing boards provide a continuous seal not only between the cover panels and the surface 47, but also to extend over and seal the joints between adjacent cover panels and any openings in the cover panels. It is understood, of course, that the sealing boards do not provide a seal for the conventional tundish pouring spout, and during the tundish preheat as well as during the casting operations, other openings or unsealed areas may provide fluid communication between the interior of the tundish and the surrounding ambient atmosphere. During preheating, the ceramic fiber sealing boards provide an effective thermal insulation for the cover panels and substantially reduce the escape of heat through openings in and around the cover panels, enabling more heat to be absorbed by the bottom and sidewalls of the tundish and a consequent substantial savings in time and energy for preheating.

As illustrated in FIG. 4, the sealing boards 62 which will be penetrated by the stopper rods 38, 40 and by the shroud tube 18 are preferably scored with a suitable blade 68 as indicated schematically by the lines 70. This scoring operation may be accomplished either prior to or after the cover panels are placed on the tundish and preferably the scoring only serves to weaken the panel so that, as the panel is penetrated by the stopper rods or shroud tube, the area surrounding the respective elements will be deflected inwardly but not broken free of the board to thereby minimize the open area in the seal caused by the insertion of these or other elements.

Prior to commencement of use of the heated tundish in a casting operation, and during preheating of the tundish tube(s) or pour tube(s), argon or other suitable inert gas is admitted, for example through inlet pipes indicated schematically at 72, to purge oxygen-containing atmosphere from the interior of the tundish. During this operation, the oxygen level in the tundish without the use of the sealing boards is typically about 15% but with use of the sealing boards, this oxygen level is quickly reduced to about 1%. This reduction in oxygen is accompanied by a corresponding reduction in free nitrogen, with the result that nitrogen pickup in steel cast at the beginning of a run with a newly lined tundish is greatly reduced, and the steel quality is correspondingly increased.

Figure 5:
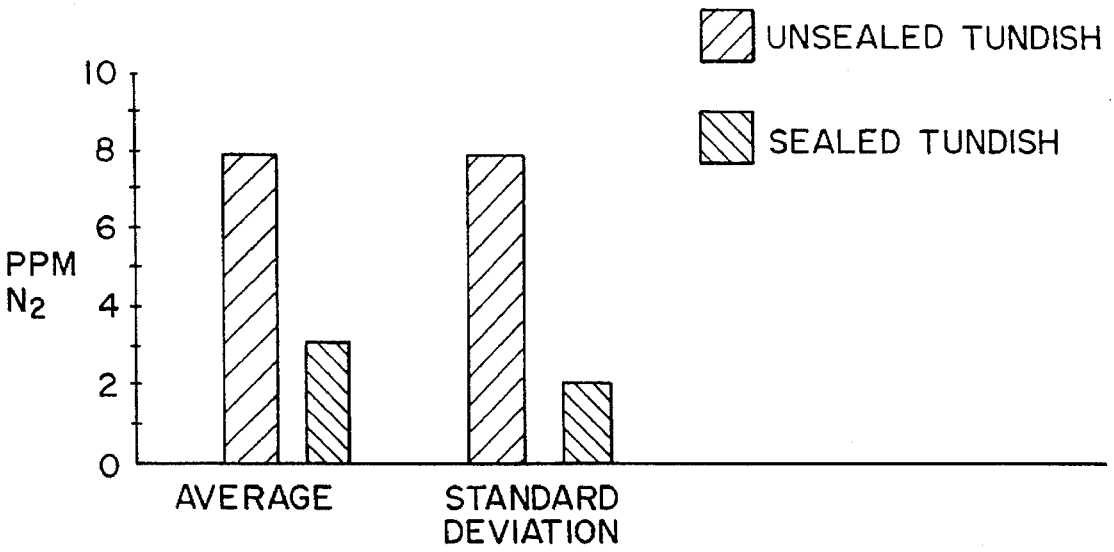
FIG. 5 is a graphic illustration of the nitrogen content of steel produced on a continuous caster in accordance with the prior art and by use of the present invention.

FIG. 5 graphically illustrates the reduction in nitrogen pickup in steel by use of the sealed tundish according to the present invention. This illustration compares the nitrogen content of steel cast on an unsealed tundish in accordance with conventional practice with that using a sealed tundish, with tests in both instances taken at about 20% into the first ladle cast on a new tundish. Comparisons are shown both on an average basis and utilizing a standard deviation computation. These tests have shown that the nitrogen, which is considered a negative factor for most high grade steels, is consistently reduced from about 8 parts per million to about 3 parts per million at this early stage in a cast using a new tundish.

From a quality aspect, use of a sealed tundish has allowed an upgrading of steel from the initial slab cast on a continuous caster utilizing a new tundish. For example, for high grade steel such as utilized by the automotive industry or for tinplate, use of the sealed tundish according to the present invention enables an upgrading of the first slab cast on each strand from "limited warranty" to "prime unexposed" and, with limited scarfing of the slab, from "no tinplate" application to regular tinplate application. The second slabs can be upgraded from "prime exposed" with scarfing of the slab to "prime exposed" without scarfing, and from tinplate application with scarfing of the slab to tinplate without scarfing. The third and fourth slabs on a tundish may be upgraded from draw-redraw and drawn-and-iron tinplate applications with scarfing of the slabs to these same applications without scarfing. It is thus apparent that the upgrading of 4 to 5 slabs on each strand of a two strand caster, with the consequent increase in market value of these heavy slabs, produces a substantial increase in revenue to the steel producer. In addition, the ceramics fiber sealing boards act as an insulation and enables an increase in the tundish temperature on the order of 200° F. This has the additional benefit of reducing the temperature loss, particularly at the start of use of a new tundish which permits use of less superheat in the liquid steel and/or an increased casting rate at steady state conditions.

While the preferred embodiment of the invention has been disclosed and described in detail, it should be apparent that the invention is not specifically limited thereto, but rather that it is intended to include all embodiments of the invention which would be apparent to one skilled in the art and which come within the spirit and scope of the invention.

What is claimed is:

1. A sealed tundish for use in a continuous steel casting operation comprising a refractory lined vessel having a bottom wall with at least one pouring opening therein, upwardly extending sidewalls, and an open top, and a top cover removably supported on and substantially closing said open top, said cover having a plurality of openings extending therethrough for the insertion of a shroud tube and one or more stopper rods into the tundish through the top cover, and sealing means extending over said open top and beneath said top cover, said sealing means including a plurality of elongated, generally rectangular, substantially planar sealing boards positioned in abutting side-by-side relation and cooperating to form a substantially continuous panel covering the open top of the tundish and forming a gasket seal between the tundish open top and the top cover and extending over and effectively closing said plurality of openings in the top cover, said sealing boards being formed from a refractory ceramic fiber material which is dimensionally stable, self-supporting and capable of being penetrated by a shroud tube and a ladle stopper rods through said openings in said top cover to permit the ladle shroud tube and one or more stopper rods to be inserted into the tundish during casting.

2. The sealed tundish defined in claim 1 wherein said refractory ceramic fiber material comprises vitreous alumina and silica.

3. The sealed tundish defined in claim 2 wherein said alumina silicate fiber comprises about 43% to 95% alumina and 5% to 56% silica, with up to about 5% of a suitable binding material.

4. The sealed tundish defined in claim 3 wherein said sealing boards have a thickness within the range of about 13 to about 38 millimeters.

5. The sealed tundish defined in claim 4 wherein said sealing boards have a rabbeted groove along their opposed side edges to provide an overlapped, shiplap-type joint.

6. The sealed tundish defined in claim 4 wherein said sealing boards have a density of about 0.18 to about 0.20 grams per cubic centimeter.

7. A method of producing steel slabs on a continuous casting operation employing a tundish of the type having an open top and a plurality of removable rigid refractory cover panels supported in side-by-side relation on the open top with at least selected ones of the cover panels have openings therethrough for the insertion of a ladle shroud tube and for the insertion and manipulation of one or more tundish stoppers during casting, the method comprising providing a tundish seal between said open top and said cover panels by initially placing a plurality of substantially planar sealing boards in side-by-side relation on the open top of the tundish and subsequently placing the cover panels onto the open top with the sealing boards providing a sealing gasket between the open top and the cover panels and with the sealing boards extending beneath and blocking the said openings of the cover panels, said sealing boards being formed from a refractory ceramic fiber material, said sealing boards being dimensionally stable and self-supporting and being capable of being penetrated by said shroud tube and one or more stopper rod passing through said openings in the cover panels to permit the insertion of a ladle shroud tube and a ladle stopper rod through said openings in the cover panels, and purging the interior of said sealed tundish with an inert gas to substantially eliminate free oxygen and nitrogen from the tundish prior to commencing the casting operation.

8. The method defined in claim 7 further comprising the step of providing a rabbeted groove along opposed side edges of said sealing boards, and positioning said boards on the open top in overlapping relation to provide a continuous shiplap joint between adjacent sealing boards.

9. The method defined in claim 7 wherein said refractory ceramic fiber material comprises from 5 to about 56 percent silica, and wherein said sealing boards have a density of about 0.18 to about 0.20 grams per cubic centimeter.

* * * * *

UNITED STATES PATENT AND TRADEMARK OFFICE

CERTIFICATE OF CORRECTION

PATENT NO. : 5,645,121

DATED : July 8, 1997

INVENTOR(S) : Thomas BARNES

It is certified that error appears in the above-indentified patent and that said Letters Patent is hereby corrected as shown below:

Claim 1, line 20 (column 6, line 27), change "rods" to -- rod --;

Claim 7, line 20 (column 6, line 65), change "rod" to -- rods --;

Claim 7, line 22 (column 6, line 67), delete -- through said openings in the cover panels --.

Signed and Sealed this

Twenty-third Day of September, 1997

*Attest:*

Bruce Lehman

BRUCE LEHMAN

*Attesting Officer*

*Commissioner of Patents and Trademarks*